US007371307B2

(12) United States Patent
van Heek et al.

(10) Patent No.: US 7,371,307 B2
(45) Date of Patent: May 13, 2008

(54) KRAFT PULP YIELD BY HEAT TREATMENT OF POLYSULPHIDE LIQUORS GENERATED BY OXIDATION

(75) Inventors: Ronald Peter van Heek, Prince George (CA); Gilles Marcel Dorris, Vimont (CA); Victor Charles Uloth, Prince George (CA); Natalie Page, Laval (CA); Thomas Qiuxiong Hu, Vancouver (CA); Denys Francois Leclerc, Vancouver (CA)

(73) Assignee: FPInnovations, Pointe-Claire, Quebec (CA)

( * ) Notice: Subject to any disclaimer, the term of this patent is extended or adjusted under 35 U.S.C. 154(b) by 348 days.

(21) Appl. No.: 10/991,527

(22) Filed: Nov. 19, 2004

(65) Prior Publication Data

US 2005/0072539 A1 Apr. 7, 2005

Related U.S. Application Data

(63) Continuation-in-part of application No. 10/053,408, filed on Jan. 23, 2002, now abandoned.

(60) Provisional application No. 60/263,519, filed on Jan. 24, 2001.

(51) Int. Cl.
*D21C 11/02* (2006.01)
*C01B 17/00* (2006.01)

(52) U.S. Cl. ..... 162/30.11; 162/29; 423/562

(58) Field of Classification Search ..... 423/562
See application file for complete search history.

(56) References Cited

U.S. PATENT DOCUMENTS 4,024,229 A 5/1977 Smith et al.

5,082,526 A * 1/1992 Dorris ..... 162/30.11

FOREIGN PATENT DOCUMENTS

WO PCT/US97/05591 * 11/1997
WO WO 97 42372 11/1997

OTHER PUBLICATIONS

Database Paperchem 'Online', The Institute of Paper Science and Technology, Atlanta, GA, US; Database Accession No. AB4701536, Ringley, M.B.: "Laboratory Polysulfide Cooking of Loblolly Pine", retrieved from Dialog XP002219846, abstract and Southern Pulp Paper MFR. 39, No. 1: 24-26, 28, 30-31 (Jan. 1976).

Multi-Stage Polysulphide Pulping Processes, Part 1, Basic Ideas and Low-Temperature Impregnation Studies on Black Spruce Heartwood, Clayton et al, Pulp and Paper Research Institute of Canada, Pointe Claire, Quebec, Dec. 1967, T-619 to T-630.

Factors Affecting Yield Increase and Fiber Quality in Polysulfide Pulping of Loblolly Pine, Other Softwoods and Red Oak, Sanyer et al, Tappi, vol. 47, No. 10, Oct. 1964, pp. 640-652.

Some Aspects of the Chemistry of Polysulfide Pulping, Ants Teder, Swedish Forest Products Research Laboratory, Stockholm, Sweden, May 1969.

Spectrophotometric Determination of Polysulfide Excess Sulfur in Aqueous Solutions, Ants Teder, The Central Laboratory of the Swedish Cellulose Industry (CCL), Stockholm, Sweden, No. 6, 197-200, Mar. 31, 1967.

* cited by examiner

*Primary Examiner*—Steven P. Griffin
*Assistant Examiner*—Michael J. Felton
(74) *Attorney, Agent, or Firm*—Ogilvy Renault LLP

(57) ABSTRACT

Oxidized white liquor is heat treated to increase the concentration of polysulphide measured at 285 or 286 nm ($PS_{UV}$) or measured at 416 nm ($PS_{VIS}$) and the $PS_{UV}/PS_{GR}$ or $PS_{VIS}/PS_{GR}$ ratio, whereby the content of active polysulphide in the total polysulphide is increased which active polysulphide can be exploited to increase pulp yield in Kraft pulping.

13 Claims, 3 Drawing Sheets

KRAFT PULP YIELD BY HEAT TREATMENT OF POLYSULPHIDE LIQUORS GENERATED BY OXIDATION

CROSS-REFERENCE TO RELATED APPLICATION

This Application is a continuation-in-part of U.S. Ser. No. 10/053,408, filed Jan. 23, 2002 (now abandoned), which claims priority under 35 U.S.C. 119(e) from U.S. Provisional Application Ser. No. 60/263,519, filed Jan. 24, 2001.

BACKGROUND OF THE INVENTION (i) Field of the Invention

The present invention relates to an improvement in any process which generates polysulphide by the oxidation of white liquor; the invention also relates to a method of increasing the yield of pulp in Kraft pulping with an oxidized white liquor.

(ii) Description of the Prior Art

In Kraft pulping operations, where the goal is to remove lignin while retaining carbohydrates, yield is increased by minimizing carbohydrate (i.e., cellulose and hemicellulose) degradation. This degradation occurs through the "peeling" reaction in which sugar units are sequentially removed from the reducing end group of the polysaccharide chains. One way to prevent this reaction is to convert aldehyde groups on the wood polysaccharides to a form which is relatively inert to further "peeling". This conversion is achieved by either oxidizing the aldehyde to its corresponding carboxylic acid (Alfredsson et al., 1963), (Holton, 1977) or, alternatively, reducing it to its alcohol form (Hartler, 1959), (Pettersson et al., 1961). The two methods that are applied in the pulp and paper industry involve the oxidation process and use anthraquinone (Holton, 1977), or polysulphide (Clayton et al., 1967), (Landmark et al., 1965), (Sanyer et al., 1964), (Teder, 1969), or both as oxidizing agents. Anthraquinone is a catalytic additive while polysulphide is generated from white liquor by oxidation of sodium sulfide in one of several processes (Dorris, 1992), (Smith et al., 1977).

SUMMARY OF THE INVENTION

It has now been found that polysulphide (PS) generated by oxidation of white liquor is a mixture of active polysulphide and inactive polysulphide.

Active polysulphide is an oxidant which oxidizes carbohydrate aldehyde groups to acid groups which are not susceptible to the peeling reaction during Kraft pulping. The oxidizing action of active polysulphide thus minimizes degradation of cellulose and hemicellulose during Kraft pulping and increases pulp yield.

Inactive polysulphide, on the other hand, cannot oxidize carbohydrate aldehyde groups and thus does not cause a pulp yield increase during Kraft pulping.

Polysulphide concentration may be measured gravimetrically or spectrometrically. Gravimetric measurement of polysulphide does not distinguish between active and inactive and provides the total concentration of polysulphide comprising both active and inactive polysulphide. Similarly, spectrometric measurement of polysulphide, at most wavelengths, measures the total concentration of polysulphide. VIS (visible light absorption) spectrophotometric measurement of polysulphide concentrations at 416 nm, however, is found to measure the. concentration of active polysulphide only. UV (ultraviolet) spectrophotometric measurement of polysulphide concentration at 285 or 286 nm is found to have contributions from both active and inactive polysulphide but primarily active polysulphide and is thus a valuable indicator of active polysulphide concentrations.

The concentration of polysulphide measured gravimetrically is referred to herein as $PS_{GR}$. This concentration ($PS_{GR}$) is thus the total concentration of polysulphide including both the active and the inactive polysulphide.

The concentration of polysulphide measured UV spectrometrically at 285 nm or 286 nm is referred to herein as $PS_{UV}$ or $PS_{285}$ or $PS_{286}$, respectively. This concentration ($PS_{UV}$) measured is thus a measure of concentration of mainly active polysulphide.

The concentration of polysulphide measured VIS (visible light absorption) spectrometrically at 416 nm is referred to herein as $PS_{VIS}$ or $PS_{416}$. This concentration ($PS_{VIS}$) is a useful measure of concentration of active polysulphide.

The ability to attain elevated concentrations of active polysulphide, i.e., $PS_{VIS}$ or $PS_{UV}$; and the ability to increase the ratio of the concentration of active polysulphide to concentration of total polysulphide, i.e., $PS_{VIS}/PS_{GR}$ or $PS_{UV}/PS/_{GR}$, enables an increase in pulp yield during Kraft pulping.

It is an object of the present invention to increase the concentration of polysulphide measured by ultraviolet light (UV) spectrometry at 285 or 286 nm (i.e., $PS_{UV}$) or the concentration of polysulphide measured by visible light absorption (VIS) spectrometry at 416 (i.e., $PS_{VIS}$) nm and the $PS_{UV}/PS_{GR}$ or $PS_{VIS}/PS_{GR}$ ratio of polysulphide liquors generated by the oxidation of white liquor without substantial loss of polysulphide charge where $PS_{GR}$ indicates the concentration of polysulphide measured gravimetrically.

It is a further object of the present invention to increase the yield of pulp from wood particles by cooking the wood particles in a polysulphide liquor having a high concentration of polysulphide measured at 285 or 286 nm (i.e., $PS_{UV}$) or measured at 416 nm (i.e., $PS_{VIS}$) and thereby increasing the $PS_{UV}/PS_{GR}$ or the $PS_{VIS}/PS_{GR}$ ratio, generated by the oxidation of white liquor, where $PS_{GR}$ is as defined above.

It is a still further object of the invention to increase the content of active polysulphide in a polysulphide liquor generated by the oxidation of white liquor.

It is another object of the present invention to increase the yield of pulp from wood particles by cooking wood particles in polysulphide liquor generated by the oxidation of white liquors and which have been thermally treated.

In accordance with one aspect of the invention, there is provided a method which comprises exposing an oxidized white liquor to a temperature effective to increase the concentration of polysulphide measured at 285 or 286 nm ($PS_{UV}$) or the polysulphide measured at 416 nm ($PS_{VIS}$) and the corresponding $PS_{UV}/PS_{GR}$ or $PS_{VIS}/PS_{GR}$ ratio of polysulphide in the oxidized white liquor, where $PS_{GR}$ is the concentration of polysulphide measured gravimetrically.

In accordance with another aspect of the invention, there is provided a method of increasing the concentration of polysulphide measured at 285 or 286 nm ($PS_{UV}$) or polysulphide measured at 416 nm ($PS_{VIS}$) and the $PS_{UV}/PS_{GR}$ or $PS_{VIS}/PS_{GR}$ ratio of a polysulphide liquor, where $PS_{GR}$ is the concentration of polysulphide measured gravimetrically, said method comprising heating or cooling if necessary and then storing said liquor at a temperature between 20° C. and 95° C. for a time of up to 72 hours.

In accordance with yet another aspect of the invention, there is provided a method of producing an oxidized white liquor containing polysulphide comprising: oxidizing a white liquor to produce an oxidized white liquor containing polysulphide and having a first $PS_{UV}/PS_{GR}$ or $PS_{VIS}/PS_{GR}$ ratio, and heating said oxidized white liquor to produce an oxidized white liquor having a second $PS_{UV}/PS_{GR}$ or $PS_{VIS}/PS_{GR}$ ratio, wherein said second ratio is greater than said first ratio, wherein $PS_{UV}$, $PS_{VIS}$ and $PS_{GR}$ are as defined hereinbefore.

In accordance with still another aspect of the invention, there is provided a method of increasing the yield of pulp in Kraft pulping with a white liquor containing polysulphide comprising: i) oxidizing a white liquor to produce an oxidized white liquor containing polysulphide, ii) heating or cooling, if necessary, and then storing said oxidized white liquor to increase the concentration of polysulphide measured at 285 or 286 nm ($PS_{UV}$) or polysulphide measured at 416 nm ($PS_{VIS}$) and the $PS_{UV}/PS_{GR}$ or $PS_{VIS}/PS_{GR}$ ratio of polysulphide in the oxidized white liquor, and in a subsequent step: iii) delignifying pulp with the oxidized white liquor from step ii), wherein $PS_{UV}$, $PS_{VIS}$ and $PS_{GR}$ are as defined hereinbefore.

In general, it is advantageous or especially preferred to increase the concentration of polysulphide measured at 416 nm ($PS_{VIS}$) and the corresponding $PS_{VIS}/PS_{GR}$ ratio.

The invention relates to the heat treatment of a polysulphide liquor generated by the oxidation of white liquor. This heat treatment is preferably at a temperature below 95° C., more preferably between 20° C. and 95° C., and most preferably between 50 and 95° C. for a time up to 72 hours, preferably 1 to 48 hours, more preferably 6 to 30 hours, and even more preferably 12 to 24 hours.

In one preferred embodiment of the invention, there is provided a method which comprises exposing an oxidized white liquor produced by oxidation of white liquor in the presence of lime mud, or $MnO_2$ or both lime and $MnO_2$ to a temperature effective to increase the concentration of polysulphide measured at 285 or 286 nm ($PS_{UV}$) or polysulphide measured at 416 nm ($PS_{VIS}$) and the $PS_{UV}/PS_{GR}$ or $PS_{VIS}/PS_{GR}$ ratio of polysulphide in the oxidized white liquor. Preferably the temperature, in this latter preferred embodiment, is below 95° C. and the period of exposure is for a time up to 72 hours; more preferably the temperature is between 50° C. and 95° C., for an exposure time of 1 to 48 hours.

In another preferred embodiment of the invention, there is provided a method of increasing the $PS_{UV}/PS_{GR}$ or $PS_{VIS}/PS_{GR}$ ratio of a polysulphide liquor generated by oxidation of white liquor in the presence of lime mud or $MnO_2$ or both lime mud and $MnO_2$, which method comprises heat treating the oxidized white liquor at a temperature between 50° C. and 95° C. for a time of up to 72 hours, and preferably 1 to 48 hours.

In still another preferred embodiment of the invention, there is provided a method of increasing the yield of pulp in Kraft pulping with a white liquor containing polysulphide comprising: i) oxidizing a white liquor in the presence of lime mud, $MnO_2$ or both lime mud and $MnO_2$ to produce an oxidized white liquor containing polysulphide, ii) heat treating the oxidized white liquor to increase the concentration of polysulphide measured at 285 or 286 nm ($PS_{UV}$) or polysulphide measured at 416 nm and the $PS_{UV}/PS_{GR}$ or $PS_{VIS}/PS_{GR}$ ratio of polysulphide in the oxidized white liquor, and iii) cooking wood chips with the oxidized white liquor from step ii) to produce pulp.

Figure 1:
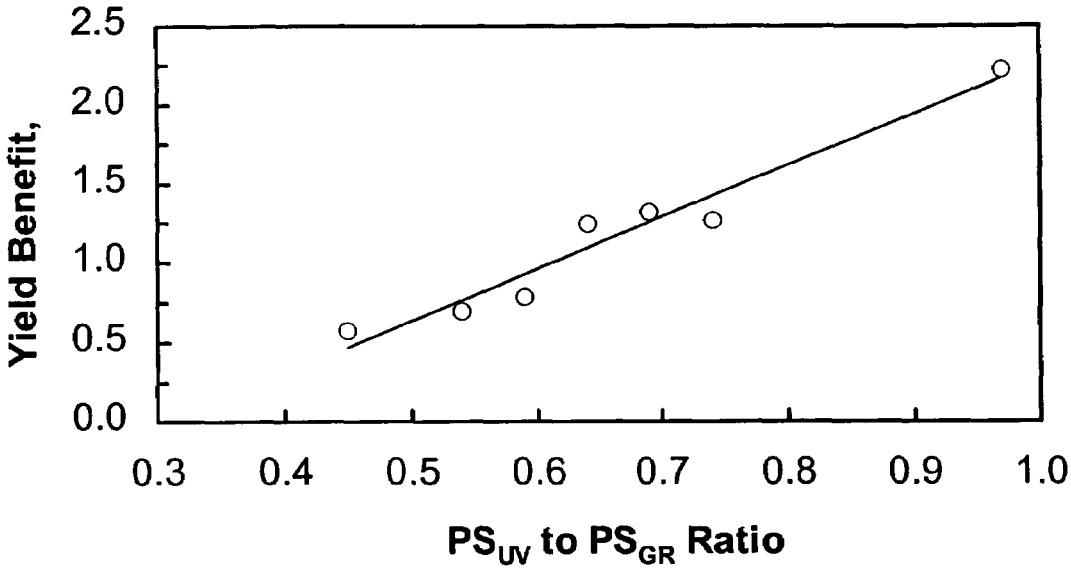
FIG. 1 illustrates graphically the yield benefit in pulp delignification with increase in $PS_{UV}/PS_{GR}$ ratio.

DETAILED DESCRIPTION OF THE INVENTION i) Oxidized White Liquor

The oxidized white liquor in this invention is one produced by oxidizing sodium sulphide in the white liquor to sodium polysulphide.

The invention is not confined to any particular oxidation procedure for producing the polysulphide or oxidized white liquor. The invention thus extends to oxidized white liquors in which the oxidation is carried out with oxygen or oxygen-containing gases such as air, in the presence of a catalyst, for example, wet-proofed activated carbon in the MOXY (trademark of The Mead Corporation) process; lime mud in the PAPRILOX (trademark of Pulp and Paper Research Institute of Canada) process, lime mud spiked with manganese dioxide; or with oxygen or oxygen containing gas in the presence of a metal oxide, such as oxides of manganese, iron, cobalt, zinc, aluminum, nickel or chromium, which metal oxide functions as a catalyst for polysulphide formation.

An especially preferred or advantageous oxidized white liquor for use in the invention is that produced by oxidation of a white liquor produced by causticizing green liquor and containing the lime mud generated in the causticization process.

Green liquor is produced from the smelt derived from black liquor in chemical recovery of a conventional Kraft liquor cycle. The green liquor comprises sodium carbonate and sodium sulphide and the causticization involves addition of lime, calcium oxide, to the green liquid. The lime reacts with the sodium carbonate to produce sodium hydroxide with precipitation of insoluble calcium carbonate. The suspended solids comprising the calcium carbonate, unreacted calcium oxide and other insoluble solids present in the smelt, is referred to as lime mud.

This lime mud is thus a by-product of the white liquor formation.

The white liquor suspension containing lime mud, can be employed directly in the production of the oxidized white liquor, as outlined in U.S. Pat. No. 5,082,526 incorporated herein by reference. Especially advantageously, a catalytic amount of manganese dioxide is added to the white liquor suspension to further enhance the oxidation. Suitable catalytic amounts of manganese dioxide comprise 0.1 to 2.0 g/l of a white liquor.

In such case, the resulting oxidized white liquor contains the lime mud and, where applicable, the added manganese dioxide catalyst, as suspended solids.

ii) Heat Treatment

The process of this invention for increasing the $PS_{UV}$, i.e., concentration of polysulphide measured at 285 or 286 nm or $PS_{VIS}$, i.e., concentration of polysulphide measured at 416 nm and the $PS_{UV}/PS_{GR}$ or $PS_{VIS}/PS_{GR}$ ratio of polysulphide liquors generated by the oxidation of white liquor, is a process in which the polysulphide liquor is heat treated within a range of temperatures and times without substantial loss of polysulphide charge.

Increasing the concentration of polysulphide measured at 285 or 286 nm (i.e., $PS_{UV}$) or measured at 416 nm (i.e., $PS_{VIS}$) and the $PS_{UV}/PS_{GR}$ or $PS_{VIS}/PS_{GR}$ ratio increases the active polysulphide content in the liquor. The oxidized white liquor is separated from the oxidation catalysts such as lime mud and manganese oxide prior to the heat treatment.

In particularly advantageous embodiments, the liquors generated by the oxidation of white liquor in the presence of $MnO_2$, lime mud or both $MnO_2$ and lime mud are heat treated at a temperature below 95° C. for a time up to 72 hours to increase the concentration of polysulphide measured at 285 or 286 nm ($PS_{UV}$) or polysulphide measured at 416 nm ($PS_{VIS}$) and the $PS_{UV}/PS_{GR}$ or $PS_{VIS}/PS_{GR}$ ratio.

The temperature of the polysulphide liquor for the heat treatment can be adjusted using a heat exchanger. The temperature of the polysulphide liquor can also be adjusted by evaporative cooling with an oxygen-containing gas. Normal practice is to remove the heat generated by the reactions between sodium sulphide and oxygen, to prevent the oxidized liquor temperature from rising to or above the liquor boiling point (Uloth et al., 1997, Tench et al., 1999). Storage may be provided by existing tankage provided both for liquor clarification and flow buffering or by new tankage. The target storage temperature and storage time can be optimized to ensure that the maximum charge of active polysulphide in the polysulphide liquor, is delivered to the pulp digester.

The heat treatment is preferably carried out by maintaining the oxidized liquor at a temperature of 50° C. to 90° C. for a time of 1 to 48 hours.

iii) Polysulphide $PS_{UV}/PS_{GR}$ or $PS_{VIS}/PS_{GR}$ Ratio

Polysulphide can be generated from sodium sulphide in a white liquor by various methods including the direct addition of sulphur to the white liquor. However, this method cannot be used industrially without a bleed of sulphur from the Kraft recovery cycle, which is expensive to provide. Having different methods of polysulphide generation, however, allows comparisons of the form of the polysulphide that is generated by each of the different methods. These comparisons have shown that there are differences in what is measured as polysulphide when polysulphide liquor is generated by the direct addition of sulphur to the white liquor and when it is generated by the oxidation of white liquor.

Polysulphide concentration can be measured in many ways, already known in the art, but two of the most simple and effective are measurement by gravimetry ($PS_{GR}$) and by UV or VIS absorption (e.g., $PS_{UV}$ or $PS_{VIS}$). The two methods can be used to give a $PS_{UV}/PS_{GR}$ or $PS_{VIS}/PS_{GR}$ ratio. Polysulphide generated by direct sulphur addition has a $PS_{UV}/PS_{GR}$ or $PS_{VIS}/PS_{GR}$ ratio very close to 1, but polysulphide generated by oxidation of white liquor has a ratio that varies depending on the way that it has been made.

Gravimetric methods for measuring or determining the concentration of polysulphide (PS) are known in the art, and reference is made to Dorris et al, Journal of Pulp and Paper Science: Vol. 20, No. 8, p. 211-214, "Analysis of Oxidized White Liquors, Part I: Determination of Polysulphides by Gravimetry", the teachings of which are incorporated herein by reference, and which describes a simple gravimetric method for determining polysulphide concentration in oxidized white liquors based on acidifying the liquor containing polysulphide to precipitate elemental sulphur.

Spectroscopic methods for measuring polysulphide concentration are also known in the art as acknowledged by Dorris et al referred to above. Reference may be made to Teder A., Svensk Papperstidn. 70(5): 197 (1967), "Spectroscopic Determination of Polysulphide Excess Sulfur in Aqueous Solutions"; Teder, A, "Some Aspects of the Chemistry of Polysulfide Pulping", Svensk Papperstidn. 72 (No. 9), May 15, 1969, pages 294-303, and to U.S. Pat. No. 5,581,684, Holmqvist et al, the teachings of which are incorporated herein by reference, for a teaching of such a spectroscopic method.

It will be understood that this invention does not reside in techniques for measuring or determining polysulphide concentration. Such techniques are part of the state of the art and the addressee will be knowledgeable of such techniques including gravimetric methods and spectroscopic methods.

It will be further understood that the concentration units are not relevant to the invention and any concentration units can be employed. In general, the concentrations of polysulphide, whether by gravimetric or spectrometric methods, are indicated herein in g/l, i.e., grams per litre, but other concentration units may be employed.

It will be evident, scientifically and mathematically, that when comparing concentrations of polysulphide determined by different methods such as in the ratios $PS_{UV}/PS_{GR}$ and $PS_{VIS}/PS_{GR}$ referred to herein, the concentrations are in the same units.

The differences in the form of polysulphide in the white liquor change the degree to which the yield of pulp is increased by the application of a given polysulphide charge. Polysulphide liquors that have a $PS_{UV}/PS_{GR}$ or $PS_{VIS}/PS_{GR}$ ratio of 1 deliver the full yield expected from the application of a given polysulphide charge in the Kraft pulping process. In such polysulphide liquors, the polysulphide content may thus be considered to be active polysulphide, i.e., polysulphide which oxidizes aldehyde groups on wood polysaccharides to inhibit carbohydrate degradation during delignification of pulp.

Oxidized liquors that have lower ratios are found to deliver diminishing amounts of the expected yield (FIG. 1).

The lower the $PS_{UV}/PS_{GR}$ or $PS_{VIS}/PS_{GR}$ ratio, the lower is the content of active polysulphide in the polysulphide of the liquor, and conversely, the higher is the content of inactive polysulphide.

It is therefore desirable in industrial application that the concentration of polysulphide measured at 285 or 286 nm ($PS_{UV}$) or measured at 416 nm ($PS_{VIS}$) and the $PS_{UV}/PS_{GR}$ or $PS_{VIS}/PS_{GR}$ ratio of the polysulphide liquor be as high as possible, or as close to 1 as possible.

The heat treatment of the invention does result in some loss in the total polysulphide content, determined as both active and inactive. The loss depends on the treatment temperature and time.

It will be recognized that the heat treatment parameters are desirably selected to establish a satisfactory content of active polysulphide for the protective oxidation of the carbohydrate aldehyde groups. As such, a balance is to be achieved between $PS_{UV}/PS_{GR}$ or $PS_{VIS}/PS_{GR}$ ratio and the actual concentration of active polysulphide. A $PS_{UV}/PS_{GR}$ or $PS_{VIS}/PS_{GR}$ ratio close to 1 will not be beneficial if the heat treatment has decreased the total polysulphide content to a level where the active polysulphide content is inadequate for the protective oxidation reaction.

On the other hand, a low $PS_{UV}/PS_{GR}$ or $PS_{VIS}/PS_{GR}$ ratio will be beneficial where the total polysulphide content remains high such that the ratio signifies an adequate active polysulphide content for the protective oxidation reaction.

In general, an active polysulphide concentration of at least 4 g/l, and preferably at least 6 g/l, in the oxidized white liquor, is required for effective oxidation of the carbohydrate aldehyde groups in the wood chips.

The active polysulphide can be measured spectrometrically, for example, at 285 nm, 286 nm (UV) or preferably and more accurately at 416 nm (VIS) wavelength.

Experimental

The liquors used to generate the results in FIG. 1 were obtained as follows. White liquors of varying concentrations and compositions (800 mL; preheated to 70° C. in a microwave oven) were brought to 90° C. (in an oil bath) in a stainless steel reactor (1 L) equipped with a condenser (5° C.) and ports for adding gas and $MnO_2$ and for withdrawing samples. During the rise to temperature, the liquor was stirred mechanically (600 rpm; Eurostar Power Digi-Visc-trademark) under a nitrogen flow (50 mL/min; 2 μm stainless steel sparger (Supelco-trademark)). The impeller type used was a Rushton disk turbine with 6 flat blades (48 mm diameter). Finely powdered $MnO_2$ (1 g/L; Brickox 6807-trademark of Prince Manufacturing Company) was added to the reactor when the liquor reached 90° C. $PS_{OWL}$ was generated by bubbling air (450 mL/min) into the liquor at a constant stirring rate of 1000 rpm. The generation of polysulphide was monitored with a UV spectrometer at 286 nm (HP Vectra QS/165-trademark; 1 mm path-length cells, oxygen-free NaOH (1N) used for dilution and blanks). An absorptivity of 43.48 $Lg^{-1}$ $cm^{-1}$ was used to calculate the concentration of $PS_{UV}$. Samples were removed from the reactor using a plastic syringe, immediately filtered on a ceramic Buchner funnel, and stored in polyethylene containers under argon prior to their analysis. The stainless steel sparger was cleaned with HCl (3 N) prior to subsequent use. The $PS_{GR}$ charge used in all the pulping experiments was 1.58% on wood (oven dried basis).

The $PS_{UV}$ measurements for the ratios shown in FIG. 1 were obtained at 286 nm, a wavelength at which all active polysulphide species absorb with the same absorptivity. The PS measurement, however, could also have been made at 416 nm with a similar relationship between $PS_{UV}/PS_{GR}$ or $PS_{VIS}/PS_{GR}$ ratio and yield being found.

Figure 2:
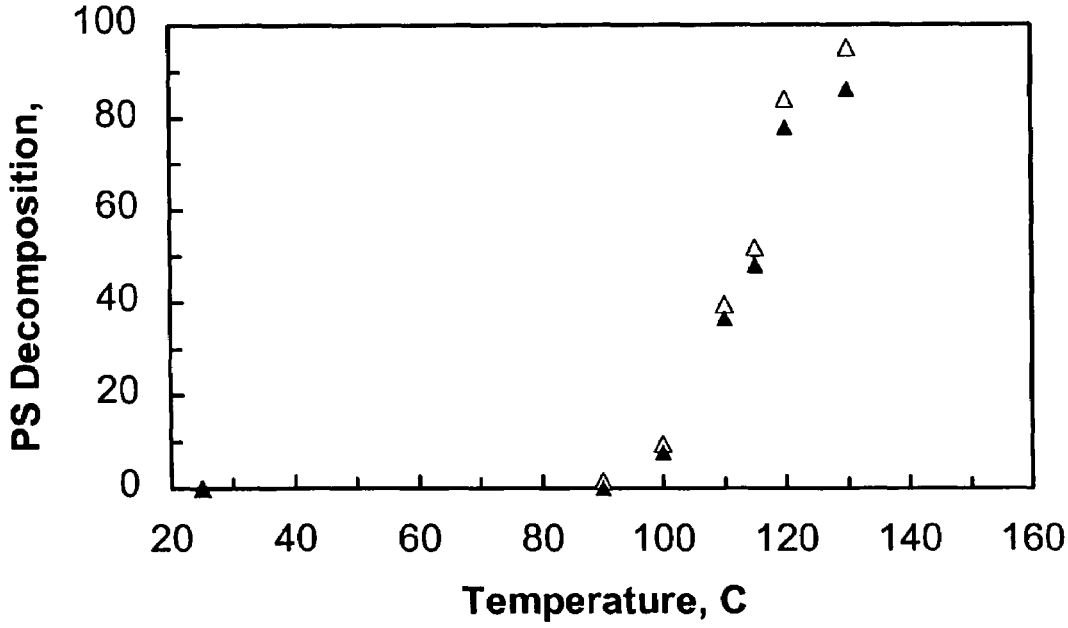
FIG. 2 illustrates graphically the relationship between polysulphide decomposition and temperature.

FIG. 2 presents the % decomposition of polysulphide determined by gravimetry and by UV spectrophotometry (286 nm) of a typical liquor produced by catalytic oxidation with manganese dioxide as it is heated at 1.8° C. per minute; this corresponds to the conventional rise to temperature used in Kraft cooking of 90 min to 170° C. It is very clear from this figure that, at temperatures above 100° C., polysulphide decomposes rapidly.

Similar results can be generated by using liquors that are produced by oxidizing white liquor with air in the presence of a wet-proofed activated carbon catalyst. At the industrial scale, this is done in a single oxidation step with compressed air blown into a fixed bed of the carbon black catalyst. Smith and Sanders (U.S. Pat. No. 4,024,229) have presented some details on the production of PTFE-coated catalyst. Industrially the MOXY (trademark of The Mead Corporation) and Chiyoda processes both use carbon as the oxidation catalyst. These processes also produce liquors that have $PS_{UV}/PS_{GR}$ ratios of less than 1 and which can be improved by the heat treatment of the invention. Heat treatment increases the concentration of $PS_{UV}$ measured at 285 or 286 nm or $PS_{VIS}$ measured at 416 nm and the $PS_{UV}/PS_{GR}$ or $PS_{VIS}/PS_{GR}$ ratio of these liquors and therefore, the fibre yield when using them for pulping.

EXAMPLES

Example 1

Oxidized white liquor was produced by causticizing 0.75 L of green liquor with 45 g reburned lime, spiked with 0.6 g $MnO_2$. The manganese content of clarified green liquor samples is typically 0.3 to 6.0 mg/L. The amount of manganese added in the $MnO_2$ in this example (504 mg/L) is about a hundred times that normally found in green liquor. After 100 min causticizing time at 90° C., oxygen was sparged into the causticized slurry at a rate of 0.1 L/min for 30 min. After oxidation, the resulting $CaCO_3$ lime mud with added $MnO_2$, was separated from the oxidized white liquor. Samples of the clarified white liquor were then stored in a thermostated bath held at a desired temperature. At regular time intervals, small samples of liquor were withdrawn for determination of polysulphide concentration in g/l by UV spectrometry at 286 nm ($PS_{UV}$) and by gravimetry ($PS_{GR}$).

Example 1 illustrates the increase in the $PS_{UV}/PS_{GR}$ ratio when a freshly oxidized white liquor is treated at 73° C. for up to 48 hours.

Table I shows that by heat treatment at 73° C. for 48 hours, the $PS_{UV}/PS_{GR}$ ratio was changed from 0.45 to 0.86 while the polysulphide concentration ($PS_{GR}$) was only decreased from 9.3 g/L to 7.1 g/L. Over 48 hours at 73° C., the $PS_{UV}$ concentration increased by 44%, from 4.23 to 6.08 gpl as sulphur. As can be seen from FIG. 1, such an increase in ratio will allow the yield increase from a given concentration of polysulphide to be increased from zero to almost the full potential of that concentration.

TABLE 1

| Stability at 73° C. | | | | |
|---|---|---|---|---|
| Sample Time (h) | 286 abs | PS concentration (UV) g/L | PS concentration (gravimetry) g/L | $PS_{UV}/PS_{GR}$ Ratio |
| 0 | 0.73 | 4.23 | 9.34 | 0.45 |
| 1 | 0.78 | 4.54 | 8.12 | 0.56 |
| 2 | 0.81 | 4.71 | 8.36 | 0.56 |
| 3 | 0.85 | 4.92 | 8.30 | 0.59 |
| 20 | 1.05 | 6.08 | 7.06 | 0.86 |
| 24 | 1.06 | 6.13 | 7.60 | 0.81 |
| 48 | 1.05 | 6.08 | 7.10 | 0.86 |

Example 2

Example 2 illustrates the change in the ratio when the same liquor is heated at 95° C. At this temperature the activation of the liquor, as measured by the change in ratio, is very rapid. Within an hour the ratio has increased to a useful 0.74. Long times of treatment (>3 hours) are less useful at this temperature because of the increasing loss of polysulphide concentration measured either by UV spectrometry at 286 nm or gravimetry.

TABLE 2

| Stability at 95° C. | | | | |
|---|---|---|---|---|
| Sample Time (h) | 286 abs | PS concentration (UV) g/L | PS concentration (gravimetry) g/L | $PS_{UV}/PS_{GR}$ Ratio |
| 0 | 0.73 | 4.23 | 9.34 | 0.45 |
| 1 | 0.80 | 4.65 | 6.32 | 0.74 |
| 2 | 0.83 | 4.81 | 5.86 | 0.82 |
| 3 | 0.85 | 4.91 | 5.36 | 0.92 |
| 20 | 0.71 | 4.11 | 5.00 | 0.82 |
| 24 | 0.70 | 4.07 | 5.30 | 0.77 |
| 48 | 0.57 | 3.31 | 4.20 | 0.79 |

Example 3

Example 3 illustrates the change in the ratio and polysulphide concentration at an intermediate temperature of 85° C. At this temperature, it takes between 2 and 3 hours for the activation of the liquor. Again longer times of treatment are less useful because of the increasing loss of polysulphide charge.

TABLE 3

| Stability at 85° C. | | | | |
|---|---|---|---|---|
| Sample Time (h) | 286 abs | PS concentration (UV) g/L | PS concentration (gravimetry) g/L | $PS_{UV}/PS_{GR}$ Ratio |
| 0 | 0.78 | 4.52 | 9.78 | 0.46 |
| 0.83 | 0.82 | 4.74 | 8.08 | 0.59 |
| 2 | 0.83 | 4.80 | 6.98 | 0.69 |
| 3 | 0.89 | 5.14 | 6.32 | 0.81 |
| 4 | 0.86 | 4.99 | 6.16 | 0.81 |
| 10 | 0.73 | 4.22 | 5.18 | 0.81 |
| 22 | 0.74 | 4.28 | 4.66 | 0.92 |
| 26 | 0.66 | 3.85 | 4.28 | 0.90 |
| 50.42 | 0.53 | 3.05 | 3.70 | 0.82 |

Example 4

Example 4 illustrates the change in the ratio and polysulphide charge at 78° C. but with the liquor having been pre-activated over 4 days at ambient temperature. The ambient temperature treatment increased the ratio from 0.46 to 0.55 without any loss of polysulphide concentration.

TABLE 4

| Stability at 78° C. | | | | |
|---|---|---|---|---|
| Sample Time (h) | 286 abs | PS concentration (UV) g/L | PS concentration (gravimetry) g/L | $PS_{UV}/PS_{GR}$ Ratio |
| 0 | 0.92 | 5.33 | 9.62 | 0.55 |
| 0.83 | 0.87 | 5.02 | 8.86 | 0.57 |
| 2.5 | 0.87 | 5.05 | 7.86 | 0.64 |
| 3.5 | 0.87 | 5.02 | 7.78 | 0.65 |
| 4.5 | 0.88 | 5.08 | 6.56 | 0.77 |
| 10 | 0.83 | 4.80 | 6.04 | 0.79 |
| 24 | 0.84 | 4.84 | 5.34 | 0.91 |
| 48 | 0.59 | 3.43 | 5.00 | 0.69 |

Example 5

Oxidized white liquor was produced by causticizing 0.75 L of green liquor with 53 g reburned lime, spiked with 1.5 g $MnO_2$. After 60 min causticizing time at 95° C., air was sparged into the causticized slurry at a rate of 0.55 L/min for 58 min. After oxidation, the resulting $CaCO_3$ lime mud with added $MnO_2$, was separated from the oxidized white liquor. Samples of the clarified white liquor were then stored in a thermostated bath held at a desired temperature. At regular time intervals, small samples of liquor were withdrawn for determination of polysulphide concentration by UV spectrometry ($PS_{UV}$) and by gravimetry ($PS_{GR}$).

Example 5 illustrates the increase in the concentration of polysulphide measured at 285 or 286 nm ($PS_{UV}$) and measured at 416 nm ($PS_{VIS}$) and the $PS_{UV}/PS_{GR}$ and $PS_{VIS}/PS_{GR}$ ratio when a freshly oxidized white liquor is treated at 60° C. for up to 20 hours.

The data in the table in this example shows that by heat treatment at 60° C. for 20 hours, the $PS_{UV}/PS_{GR}$ or $PS_{285}/PS_{GR}$ ratio was changed from 0.44 to 0.60, and the $PS_{VIS}/PS_{GR}$ or $PS_{416}/PS_{GR}$ ratio increased from 0.18 to 0.40, while the gravimetric polysulphide concentration was only decreased from 8.4 g/L to 7.5 g/L. The $PS_{416}$ concentration in the oxidized liquor doubled from 1.5 to 3.0 gpl (as sulphur) during the 20 hours of storage at 60 C. As can be seen from FIG. 1, such an increase in the $PS_{UV}/PS_{GR}$ or $PS_{285}/PS_{GR}$ ratio will allow the yield increase from a given concentration of polysulphide to be increased from zero to approximately a third of the full potential of that concentration.

TABLE 5

| Stability at 60° C. | | | | | |
|---|---|---|---|---|---|
| Sample Time (h) | PS concentration (gravimetry) g/L | PS concentration (UV 285) g/L | PS concentration (Vis 416) g/L | UV 285/ Grav ratio | Vis 416/ Grav ratio |
| 0 | 8.4 | 3.7 | 1.5 | 0.44 | 0.18 |
| 1 | 8.3 | 3.8 | 1.6 | 0.46 | 0.19 |
| 3 | 8.1 | 3.8 | 1.8 | 0.47 | 0.22 |
| 16 | 7.9 | 4.3 | 2.7 | 0.54 | 0.34 |
| 20 | 7.5 | 4.5 | 3.0 | 0.60 | 0.40 |

Example 6

Example 6 illustrates the change in the ratio when the same liquor is heat treated at 80° C. At this temperature the activation of the liquor, as measured by the change in ratio, is more rapid. Within 16 hours the ratio has increased to a useful 0.89.

The data in the table in this example shows that by heat treatment at 80° C. for 20 hours, the $PS_{UV}/PS_{GR}$ or $PS_{285}/PS_{GR}$ ratio was changed from 0.44 to 0.93, and the $PS_{VIS}/PS_{GR}$ or $PS_{416}/PS_{GR}$ ratio increased from 0.18 to 0.86, while the gravimetric polysulphide concentration was decreased from 8.4 g/L to 4.6 g/L. As can be seen from FIG. 1, such an increase in $PS_{UV}/PS_{GR}$ or $PS_{285}/PS_{GR}$ ratio will allow the yield increase from a given concentration of polysulphide to be increased from zero to almost the full potential of that concentration.

TABLE 6

| Stability at 80° C. | | | | | |
|---|---|---|---|---|---|
| Sample Time (h) | PS concentration (gravimetry) g/L | PS concentration (UV 285) g/L | PS concentration (Vis 416) g/L | UV 285/ Grav ratio | Vis 416/ Grav ratio |
| 0 | 8.4 | 3.7 | 1.5 | 0.44 | 0.18 |
| 1 | 7.7 | 3.8 | 1.9 | 0.49 | 0.25 |
| 3 | 6.6 | 4.0 | 2.6 | 0.60 | 0.39 |
| 16 | 4.8 | 4.3 | 3.9 | 0.89 | 0.81 |
| 20 | 4.6 | 4.3 | 4.0 | 0.93 | 0.86 |

Example 7

Example 7 illustrates the change in the ratio when a similar liquor is heat treated at 70° C. At this temperature the activation of the liquor, as measured by the change in ratio, is less rapid than at 80° C., but more rapid than 60° C. Within 20 hours, the $PS_{UV}/PS_{GR}$ or $PS_{285}/PS_{GR}$ ratio has increased to a useful 0.72 and the $PS_{VIS}/PS_{GR}$ or $PS_{416}/PS_{GR}$ ratio increased from 0.21 to 0.57. Through 20 hours of heat treatment at 70 C., the $PS_{416}$ concentration was more than doubled from 1.8 to 3.8 gpl (as sulphur).

TABLE 7

| Stability at 70° C. | | | | | |
|---|---|---|---|---|---|
| Sample Time (h) | PS concentration (gravimetry) g/L | PS concentration (UV 285) g/L | PS concentration (Vis 416) g/L | UV 285/ Grav ratio | Vis 416/ Grav ratio |
| 0 | 8.5 | 4.0 | 1.8 | 0.47 | 0.21 |
| 1 | 8.7 | 4.0 | 1.8 | 0.46 | 0.21 |
| 3 | 8.5 | 4.1 | 2.2 | 0.48 | 0.26 |
| 5 | 8.0 | 4.2 | 2.3 | 0.52 | 0.29 |
| 16 | 6.6 | 4.7 | 3.5 | 0.71 | 0.53 |
| 20 | 6.7 | 4.8 | 3.8 | 0.72 | 0.57 |

Example 8

Example 8 illustrates the change in the ratio when the same liquor is heat treated at 90° C. At this temperature, the activation of the liquor, as measured by the change in ratio, is very rapid. Within 5 hours, the $PS_{UV}/PS_{GR}$ or $PS_{285}/PS_{GRAV}$ ratio has increased to a useful 0.84, and the $PS_{VIS}/PS_{GR}$ or $PS_{416}/PS_{GR}$ ratio increased from 0.21 to 0.74, while the gravimetric polysulphide concentration was decreased from 8.5 g/L to 4.3 g/L. Longer times at this temperature resulted in a lower $PS_{GR}$, $PS_{UV}$ and $PS_{VIS}$ concentrations with only a small gain in the ratios.

TABLE 8

| Stability at 90° C. | | | | | |
|---|---|---|---|---|---|
| Sample Time (h) | PS concentration (gravimetry) g/L | PS concentration (UV 285) g/L | PS concentration (Vis 416) g/L | UV 285/ Grav ratio | Vis 416/ Grav ratio |
| 0 | 8.5 | 4.0 | 1.8 | 0.47 | 0.21 |
| 1 | 6.9 | 3.7 | 2.2 | 0.53 | 0.31 |
| 3 | 4.8 | 3.6 | 2.9 | 0.74 | 0.61 |
| 5 | 4.3 | 3.6 | 3.2 | 0.84 | 0.74 |

TABLE 8-continued

| Stability at 90° C. | | | | | |
|---|---|---|---|---|---|
| Sample Time (h) | PS concentration (gravimetry) g/L | PS concentration (UV 285) g/L | PS concentration (Vis 416) g/L | UV 285/ Grav ratio | Vis 416/ Grav ratio |
| 16 | 3.8 | 3.3 | 3.1 | 0.86 | 0.80 |
| 20 | 3.6 | 3.3 | 3.1 | 0.91 | 0.84 |

Example 9

Figure 3:
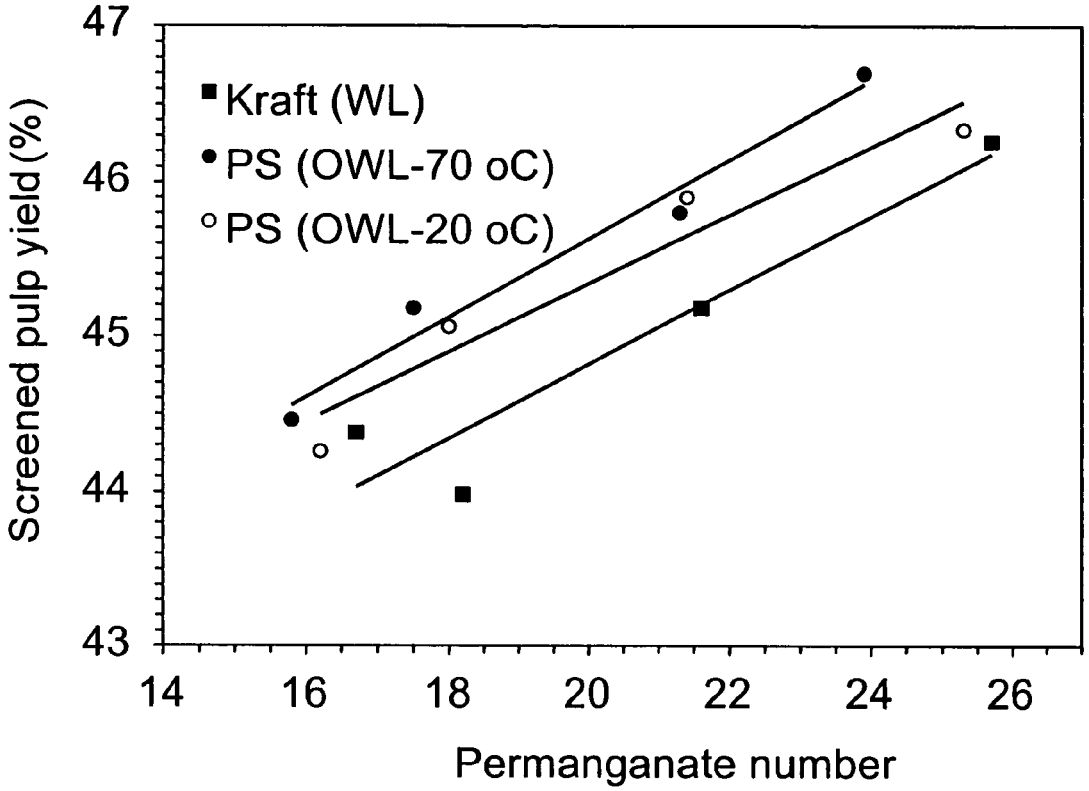
FIGS. 3 and 4 show the relationship between pulp yield and permanganate number for polysulphide liquors of the invention at different temperatures; and for a Kraft conventional white liquor for a softwood (FIG. 3) and a hardwood (FIG. 4) pulp.

Unclarified mill white liquor containing 100 g/L of lime mud was oxidized with air in the presence of 2.0 g/L $MnO_2$ at 85-90° C. for 60 minutes, cooled quickly to room temperature (20° C.) using a water bath and filtered to remove the lime mud and to give a clarified oxidized white liquor. One portion of the oxidized white liquor was treated at 70° C. for 20 hours. Another portion was stored at room temperature (20° C.) for 20 hours. The polysulphide concentrations in these two oxidized white liquors were determined by gravimetry to be $PS_{GR}$=6.4 g/L and 7.7 g/L, respectively, and by UV to be $PS_{UV}$=5.1 g/L and 3.8 g/L, respectively. The $PS_{UV}/PS_{GR}$ of the oxidized white liquor treated at 70° C. for 20 hours (OWL-70° C.) was thus 0.80 and the $PS_{UV}/PS_{GR}$ of the oxidized white liquor stored at 20° C. for 20 hours (OWL-20° C.) was 0.49. The same amounts of these two oxidized white liquors were then used for the pulping of mixed softwood chips (50/50 black spruce and pine) in a micro-digester using 50 g (OD weight) of the wood chips in each of four stainless steel laboratory bombs. A control Kraft cook using the white liquor (WL) was also carried. out. The liquor to wood ratio and the maximum cooking temperature were 4.5 to 1 and 170° C., respectively. The $PS_{GR}$ charges were 1.3 and 1.5% (on wood) for the cook using OWL-70° C. and the cook using OWL-20° C., respectively. Each bomb was cooked to a certain H-factor. Upon completion of each cook, the pulp from each bomb was well washed and screened through a laboratory flat screen plate (0.2 mm or 0.008" slot). The screened pulp yields were measured by weighing the oven-dried screened pulps and the permanganate numbers determined according to PAPTAC, Standard G. 17H. FIG. 3 shows that the PS cook using the heat-treated oxidized white liquor (OWL-70° C.) at a ratio of $PS_{UV}/PS_{GR}$=0.80 gives a higher yield gain over the Kraft reference than the cook using oxidized white liquor without the heat treatment (OWL-20° C.) at a ratio of $PS_{UV}/PS_{GR}$=0.49.

Example 10

Unclarified mill white liquor containing 100 g/L of lime mud was oxidized with air in the presence of 2.0 g/L $MnO_2$ at 85-90° C. for 60 minutes, cooled quickly to room temperature (20° C.) using a water-bath and filtered to remove the lime mud and to give a clarified oxidized white liquor. One portion of the oxidized white liquor was treated at 70° C. for 20 hours. Another portion was stored at room temperature (20° C.) for 20 hours. The polysulphide concentrations in these two oxidized white liquors were determined by gravimetry to be $PS_{GR}$=6.0 g/L and 7.6 g/L respectively. The same amounts of these two oxidized white liquors were then used for the pulping of maple chips in a micro-digester using 50 g (OD weight) of the wood chips in each of four stainless steel laboratory bombs. A control Kraft cook using the white liquor (WL) was also carried out. The liquor to wood ratio and the maximum cooking temperature were 4.0 to 1 and 165° C., respectively. The $PS_{GR}$ charges were 1.1 and 1.4%

Figure 4:
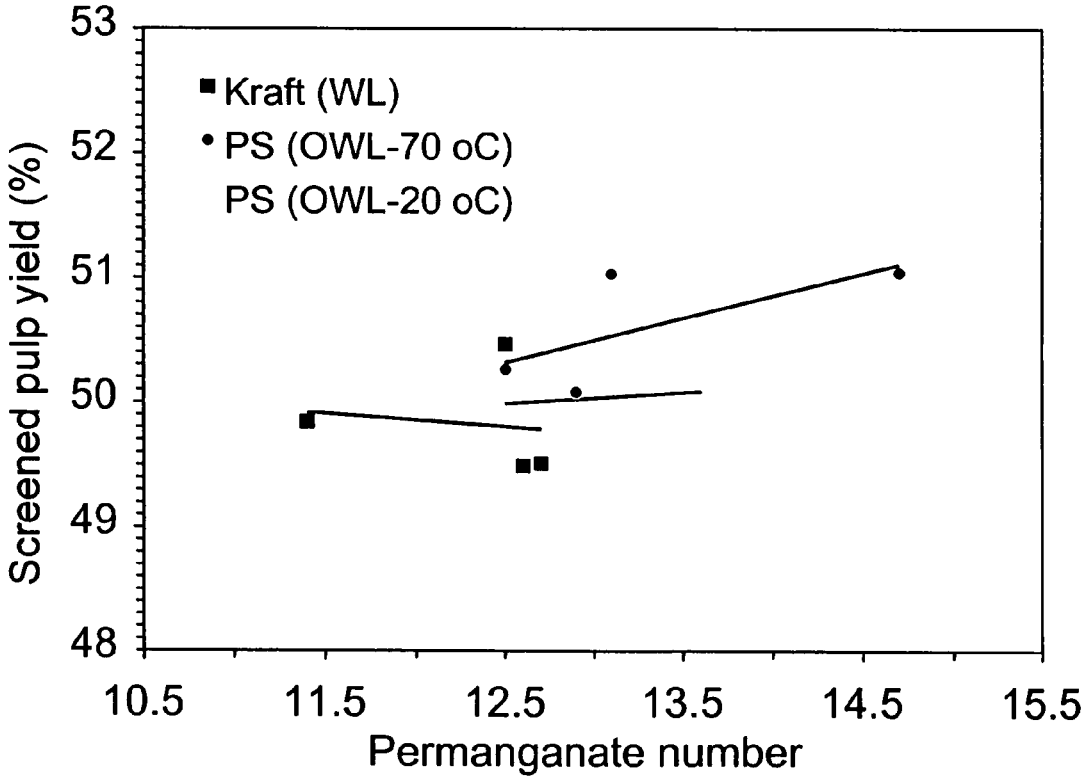

(on wood) for the cook using OWL-70° C. and the cook using OWL-20° C., respectively. Each bomb was cooked to a certain H-factor. Upon completion of each cook, the pulp from each bomb was well washed and screened through a laboratory flat screen plate (0.2 mm or 0.008" slot). The screened pulp yields were measured by weighing the oven-dried screened pulps and the permanganate numbers determined according to PAPTAC, Standard G. 17H. FIG. 4 shows that the PS cook using the heat-treated oxidized white liquor (OWL-70° C.) again gives a higher yield gain over the Kraft reference than the cook using oxidized white liquor without the heat treatment (OWL-20° C).

Example 11

Figure 5:
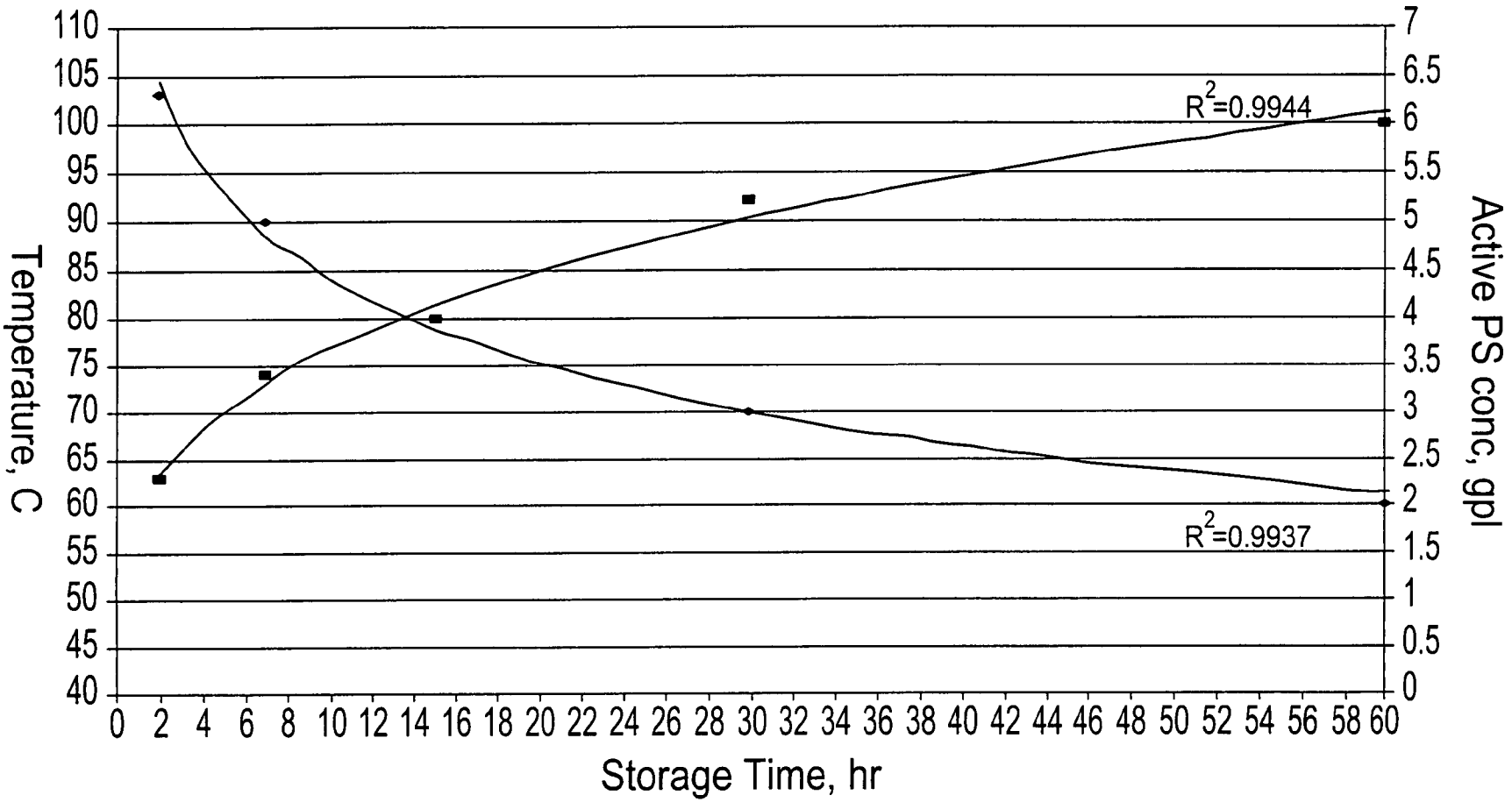
FIG. 5 shows the relationship between storage time and temperature for producing the maximum amount of $PS_{UV}$ and the value (measured as absorbance) of this maximum.

This example (through FIG. 5) summarizes the optimum storage time needed to maximize the $PS_{UV}$ content of a polysulphide liquor generated by the oxidation of white liquor. The active polysulphide concentration ($PS_{416}$) at a given storage time is described by the curve which increases with time. The temperature at which the liquor is held in storage is described by the curve that decreases with time. FIG. 5 shows that, at the lowest temperature evaluated (60° C.), a storage time of 60 hours is needed to produce 6 g/L of active polysulphide from a liquor initially having a $PS_{GR}$ concentration of 8.5 g/L. At the highest temperature evaluated (103° C.) a storage time of 2 hours is needed to produce 2.3 g/L of active polysulphide from the same liquor.

FIG. 5 shows the optimum storage temperature vs. time for maximum $PS_{416}$, and thus shows temperature to reach maximum active PS, and active PS concentration available for pulping.

Example 12

In this example, a polysulphide liquor was made with $MnO_2$ but without lime mud. A synthetic white liquor was prepared from sodium hydroxide and sodium sulphide. A sample (750 mL) of this white liquor was oxidized using air at 450 ml/min with 0.4 grams of a commercial grade $MnO_2$ (0.53 g/L $MnO_2$). The composition of the synthetic white liquor and the product oxidized liquor are illustrated in Table 9. Table 10 shows that heat treatment at 77° C. for 16.5 hours of this type of oxidized liquor is effective in increasing the $PS_{UV}/P_{GR}$ ratio from 0.46 to 0.97 and increasing the $PS_{416}$ concentration in the oxidized liquor from 1.4 to 3.3 gpl (as sulphur).

TABLE 9

Composition of liquors used in this example.

| | Synthetic White Liquor | 60 minutes Oxidation |
|---|---|---|
| $Na_2S$, g/L as S | 18.11 | 11.16 |
| PS, g/L as S | 0.24 | 7.14 |
| % Selectivity | n/a | 99 |

TABLE 10

Effect of thermal treatment (storage at 77° C. for 16.5 hours) with a polysulphide liquor generated with $MnO_2$ in the absence of lime mud.

| | 285 nm PS, g/L S | 416 nm PS, g/L S | Gravimetric PS, g/L S | UV 285/grav ratio |
|---|---|---|---|---|
| Before Thermal treatment | 3.3 | 1.4 | 7.14 | 0.46 |

TABLE 10-continued

Effect of thermal treatment (storage at 77° C. for 16.5 hours) with a polysulphide liquor generated with $MnO_2$ in the absence of lime mud.

| | 285 nm PS, g/L S | 416 nm PS, g/L S | Gravimetric PS, g/L S | UV 285/grav ratio |
|---|---|---|---|---|
| After Thermal treatment | 3.6 | 3.3 | 3.65 | 0.97 |

Example 13

In this example, a polysulphide liquor was made with a wet-proofed activated carbon catalyst. Wet proofing was done by spraying a dry film lubricant (TFE in Freon-trademark) on activated carbon (50-200 mesh from Fisher Scientific Co. Ltd.). The resulting paste was dried in the fume hood under a flow of nitrogen.

Table 11 shows that heat treatment at 65° C., or aging at 25° C., over 60 hours of this type of oxidized liquor increases the active polysulphide from 2.15 g/L to 4.55-5.68 g/L.

The oxidation was done at room temperature by adding 5 g of wet-proofed carbon to about 300 mL of artificial white liquor pre-heated to 85° C. in a 500 mL beaker. Oxidation was done for about 15 h by letting air diffuse through the floating carbon into the white liquor. Samples of the oxidized liquor were then analyzed by gravimetry and by UV spectrophotometry, just after production (fresh) and then after storage for 60 h at 25° C. Another aliquot of the fresh oxidized liquor was also stored at 65° C. for 60 h and then analyzed again.

The effect of liquor aging on the change in active ($PS^{act}$), inactive ($PS^{inact}$) and total ($PS^{tot}$) concentrations of polysulphides is presented in Table 11.

TABLE 11

Effect of thermal treatment with a polysulphide liquor generated using a wet-proofed activated carbon catalyst

| | PS concentrations (g/L, as S) | | |
|---|---|---|---|
| MOXY-type liquor | $PS^{act}$ | $PS^{inact}$ | $PS^{tot}$ |
| Fresh | 2.15 | 10.39 | 12.54 |
| Aged 60 h at 25° C. | 4.55 | 3.07 | 7.62 |
| Aged 60 h at 65° C. | 5.68 | 3.58 | 9.20 |

LITERATURE REFERENCES

Alfredsson, B., Samuelson, O. and Sandstig, B. Carboxyl end groups in sulfate and polysulphide pulps. *Svensk Papperstidn.* 66(18):703 (1963).

Clayton, D. W. and Sakai, A. Multi-stage polysulphide pulping processes. Part I. Basic ideas and low-temperature impregnation studies on black spruce heartwood. *Pulp Pap. Mag. Can.* 68(12):619 (1967).

Dorris, G. M. Process of producing Kraft pulping liquor by the oxidation of white liquor in the presence of lime mud. U.S. Pat. No. 5,082,526, Paprican (1992).

Hartler, N. Sulphate cooking with the addition of reducing agents. Part 1. Preliminary report on the addition of sodium borohydride. *Svensk Papperstidn.* 62(13):467 (1959).

Holton, H. H. Delignification of lignocellulosic material with an alkaline liquor in the presence of a cyclic keto compound. U.S. Pat. No. 4,012,280, C.I.L. (1977).

Landmark, P. A., Kleppe, P. J. and Johnsen, K. Cooking liquor oxidation and improved cooking technique in polysuphide pulping. *Tappi J.* 48(5):56 (1965).

Pettersson, S. E. and Rydholm, S. A. Hemicelluloses and paper properties of birch pulps. Part 3. *Svensk Papperstidn.* 64(1):4 (1961).

Sanyer, N. and Laundrie, J. F. Factors affecting yield increase and fiber quality in polysulphide pulping of loblolly pine, other softwoods, and red oak. *Tappi J.* 47(10):640 (1964).

Smith, G. C. and Sanders, F. W. Production of polysulphide with PTFE coated catalyst. U.S. Pat. No. 4,024,229 (1977).

Teder, A. Spectroscopic Determination of Polysulfide Excess Sulfur in Aqueous Solutions, *Svensk Papperstidn.* 70(5): 197 (1967).

Teder, A. Some aspects of the chemistry of polysulphide pulping. *Svensk Papperstidn.* 72(9):294 (1969).

*Tench, L., Uloth, V., Dorris, G., Homsey, D., and Munro, F. Mill Scale Implementation of Paprican's Process for Polysulphide Liquor Production in Kraft Mill's Causticizers, Part 1: Batch Trials and Process Optimization. *Tappi J.* 82 (10): 120 (1999).

Uloth, V., Dorris, G., Thring, R., Hogikyan, R., Tench, L., and Ayton, J. Production of Polysulphide Liquor in a Kraft Mill's Causticizers. *Tappi J.* 80(10): 223 (1997).

The invention claimed is:

1. A method of producing an oxidized white liquor containing polysulphide comprising:

i) oxidizing a white liquor with oxygen containing gas in the presence of lime mud, manganese dioxide or both to produce on oxidized white liquor containing polysulphide and having a first active polysulphide concentration measured at 285 or 286 nm ($PS_{UV}$) or a first active polysulphide concentration measured at 416 nm ($PS_{VIS}$) or a first $PS_{UV}/PS_{GR}$ or $PS_{VIS}/PS_{GR}$ ratio, and ii) storing said oxidized white liquor at a temperature of 50° C. to 90° C. for a time of 6 to 72 hours while monitoring the concentration of active polysulphide spectrometrically and the concentration of total polysulphide gravimetrically to produce an oxidized white liquor having a second active polysulphide concentration measured at 285 or 286 nm ($PS_{UV}$) or a second active polysulphide concentration measured at 416 nm ($PS_{VIS}$), wherein said second concentration is greater than said first concentration; or a second $PS_{UV}/PS_{GR}$ or $PS_{VIS}/PS_{GR}$ ratio, wherein said second ratio is greater than said first ratio.

2. A method according to claim 1, wherein step ii) comprises heating said oxidized white liquor to said temperature of 50° C. to 90° C. and storing said oxidized white liquor at said temperature for said time of 6 to 72 hours.

3. A method according to claim 2, wherein said temperature is 50 to 80° C. and said time is 6 to 48 hours.

4. A method according to claim 1, including prior to step i):

causticizing a green liquor with lime in the presence of manganese dioxide to produce said white liquor and lime mud containing said manganese dioxide.

5. A method according to claim 1, wherein step ii) comprises cooling said oxidized white liquor to said temperature of 50° C. to 90° C. and storing said oxidized white liquor at said temperature for said time of 6 to 72 hours.

6. A method according to claim 5, wherein said temperature is 50 to 80° C. and said time is 6 to 48 hours.

7. A method according to claim 1, wherein step ii) is carried out for a time of 6 to 30 hours.

8. A method according to claim 1, wherein step ii) is carried out for a time of 12 to 24 hours.

9. A method according to claim 1, wherein said temperature is 60° C. to 80° C. and said time is 6 to 48 hours.

10. A method according to claim 2, wherein step ii) is carried out for a time of 6 to 30 hours.

11. A method according to claim 2, wherein step ii) is carried out for a time of 12 to 24 hours.

12. A method according to claim 5, wherein said temperature is 60° C. to 80° C. and said time is 6 to 30 hours.

13. A method according to claim 12, wherein step ii) is carried out for a time of 12 to 24 hours.

* * * * *